United States Patent [19]

Kastner

[11] Patent Number: 5,024,643

[45] Date of Patent: Jun. 18, 1991

[54] STAPLELESS STAPLER

[76] Inventor: Arnold Kastner, c/o 10220 Armand-Lavergne, Montreal North, Quebec H1H 3N5, Canada

[21] Appl. No.: 409,697

[22] Filed: Sep. 20, 1989

[30] Foreign Application Priority Data

Sep. 27, 1988 [CA] Canada ..... 578617

[51] Int. Cl.[5] ..... B31F 5/02; B25B 27/14; B25C 5/00

[52] U.S. Cl. ..... 493/351; 493/353

[58] Field of Search ..... 493/350, 351, 353, 390, 493/392, 393, 394

[56] References Cited

U.S. PATENT DOCUMENTS

| | | | |
|---|---|---|---|
| 1,065,904 | 6/1913 | Bump | 493/351 |
| 1,173,425 | 2/1916 | Hawkins | 493/351 |
| 1,283,063 | 10/1918 | Bump | 493/351 |
| 1,324,103 | 12/1919 | Cone | 493/351 |
| 1,487,079 | 3/1924 | Stillwagon | 493/351 |
| 1,664,289 | 3/1928 | Feathers | 493/351 |

*Primary Examiner*—William E. Terrell

*Attorney, Agent, or Firm*—McFadden, Fincham, Marcus & Anissimoff

[57] ABSTRACT

A stapleless stapler has a reciprocating punch and chisel, the punch of hollow U-shaped form for cutting tongue shaped sections from sheets. A pivoting bending member bends the tongue shaped sections down and up, the free ends of the sections extending into a slot in the paper sheets cut by the chisel.

9 Claims, 4 Drawing Sheets

STAPLELESS STAPLER

BACKGROUND OF THE INVENTION (1) Field of the Invention

This invention relates to staples for stapling or connecting loose sheets of paper together. Particularly, the invention relates to a stapler for connecting or holding loose sheets together without the use of staples.

(2) Description of the Related Art

Conventional stapling machines use wire staples connected together in strips for insertion into a stapler, individual staples being sheared from the strip by actuation of a shearing member. The shearing member pushes the staple down so that the legs of the staple penetrate through the sheets of paper. An anvil is mounted below the shearing member and as the staple is pushed through the sheets of paper, the ends of the legs are bent over, usually inwards, towards each other. The legs are finally compressed tightly against the lower surface of the bottom sheet of paper.

It can happen that one, or both, of the staple legs do not pass through the paper correctly. It may distort on passing through the paper and then are not readily bent over by the anvil. Tearing of the paper can occur and the ends of the leg may stick up, presenting a danger to handlers of the stapled sheets.

A further problem is that even if the staple passes through the papers correctly, the legs may collapse under the pressure applied by the sharing member, when the legs start to be bent by the anvil. A poorly stapled assembly can occur in which the bottom sheet, or sheets, can become detached and the legs can stick out.

It is necessary to refill a stapler from time to time, and it is very inconvenient having to stop and refill during a stapling operation. The strips of staples themselves are awkward to handle and often break into sections before being filled into the machine. Any misalignment, slight variations in manufacture, and other inconsistencies can result in the stapler jamming.

When pages or sheets are stapled together, it is necessary to use a tool to remove staples to separate the sheets. During such removal, tearing of sheets can occur, and the removed staples present a hazard unless they are carefully deposited in a proper container, for example, a rubbish bin or the like.

The overall size—length—of a stapler reflects the capacity. The actual size necessary to provide acceptable overlap over the edges of a sheet is quite small. However, to provide storage for a reasonable number of staples requires a much longer stapler, approximately 50 staples requiring one inch of length, although this depends on the size and also the strength, that is the metal dimensions of the staples.

SUMMARY OF THE INVENTION

The present invention provides a stapler which does not require staples. It cuts out, bends, and reinserts a tongue of paper so as to fasten several sheets together. There are no separate staples, no anvil to bend staples, no reloading or refilling is required. Unfastening is very simple and easy and does not produce loose staples.

Broadly, a stapler in accordance with the present invention has a first cutter which cuts a tongue in each of the superposed sheets of paper, the tongues being bent down. Simultaneously with the cutting of the tongue, a slot is cut through the paper sheets, aligned with but spaced from the tongues, being spaced from the bends of the tongue. A deflecting finger pivots round and deflects the tongues round. The free ends of the tongues are then moved up through the slot. A simple, neat, fastening is formed. It can readily be unfastened by pulling the tongues back out of the slot.

In accordance with the invention, there is provided a stapleless stapling apparatus having a base; a housing mounted on said base; a slot formed between a bottom part of said housing and said base for reception of sheets of paper; a handle; a plunger reciprocally mounted in said housing for movement by said handle; a punch and a chisel reciprocally mounted in said housing for movement by said plunger, said punch having a hollow U-shaped cross-section adapted to cut a tongue-shaped section from said sheets; a bending member pivotally mounted in said punch, said bending member including means for engaging on the bottom surface of said housing to pivot the bending member; the arrangement such that initial actuation of said handle pushes down said punch and said chisel to cut tongue-shaped sections from said sheet and cut a slot in said sheets, continued actuating of the handle pivoting said bending member to bend up said tongue for insertion into the slot cut by said chisel.

In one form of the invention, the handle and plunger move vertically, in the housing, direct pressure being applied to the handle and plunger. In another form, the handle is elongate, extending over the housing and plunger and is pivotally mounted at one end. Pressure on the other end of the handle pivots the handle down, moving the plunger down.

In accordance with this invention, the tongue-shaped section has an enlarged leading end which is most desirably in the form of an arrow-head configuration, although other like configurations may be employed for that purpose.

Another preferred aspect of the invention is where the apparatus includes a slot extending through said chisel, adjacent the free end thereof, said tongue shaped sections adapted to be inserted into the slot and chisel by said bending member, with retraction of said chisel being adapted to pull said tongue shaped sections through said slot cut in the sheets by said chisel.

A still further preferred form is where the apparatus includes a reciprocating member in said housing mounted on an inner end of said plunger, said punch and said chisel mounted on said reciprocating member.

Another preferred embodiment is where said bending member comprising an arcuate member, the curved end portion of the arcuate member bending said tongue-shaped sections.

In a preferred embodiment is shown an apparatus, wherein the enlarged leading end of said punch has a projection on at least one side to form a projection on the corresponding side of the tongue shaped sections.

A further preferred embodiment shows a punch having a projection on each side adjacent its closed end, to form a projection on each side of each tongue-shaped section adjacent its free end.

A further preferred embodiment has a bending member having a curved end portion when viewed from the side, said curved end portion having an arcuate cross-section, with the concave surface facing inward, whereby the free ends of the tongue-shaped sections are formed into a trough like form as they are pushed by said bending member.

BRIEF DESCRIPTION OF THE DRAWINGS

The invention will be readily understood by the following description of certain embodiments by way of example, in conjunction with the accompanying drawings in which.

DESCRIPTION OF THE PREFERRED EMBODIMENTS

Figure 1:
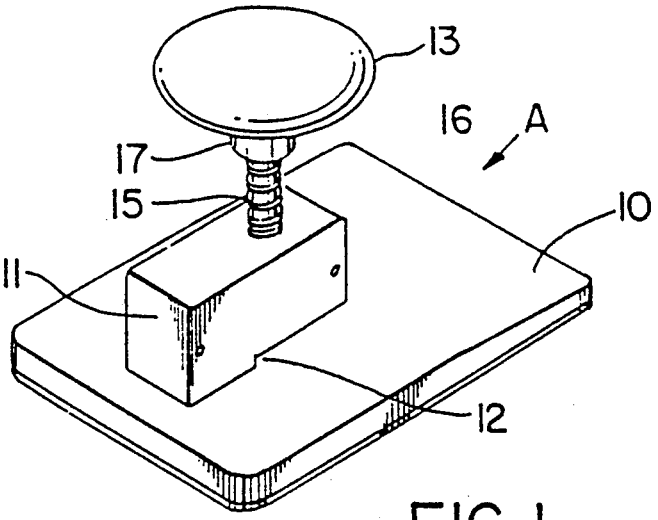
FIG. 1 is a perspective view of one form of stapler in accordance with the invention.
Figure 2:
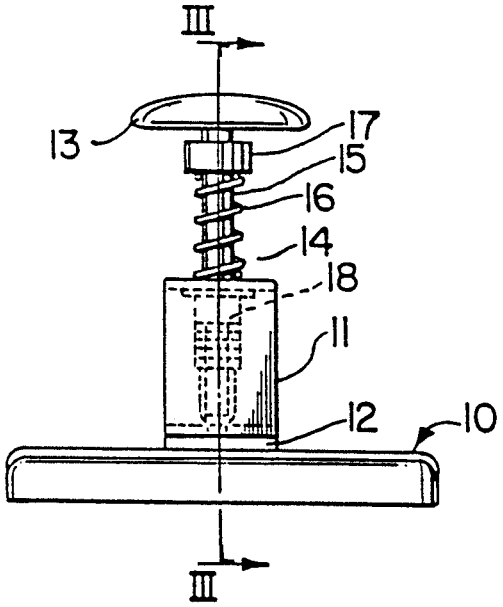
FIG. 2 is a front view in the direction of arrow A in FIG. 1.
Figure 3:
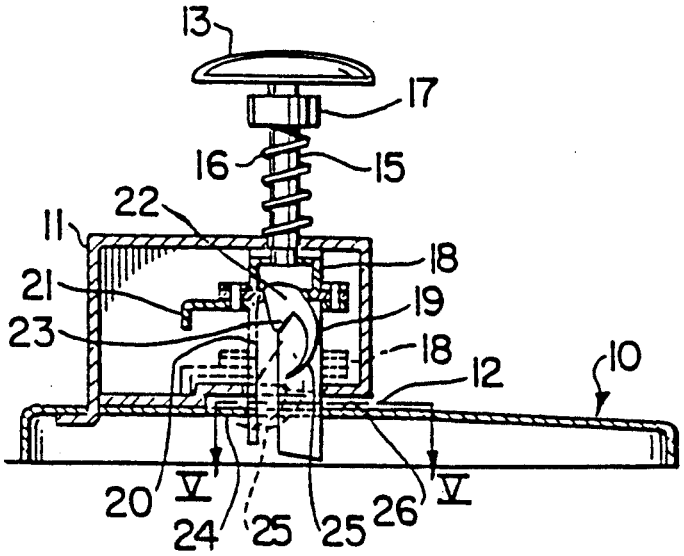
FIG. 3 is a cross-section on the line 3—3 of FIG. 2.

As illustrated in FIGS. 1 and 3, a stapler in accordance with this invention has a base 10 on which is mounted a hollow housing 11. At what can be considered as the front, the housing 11 is recessed to provide a slot or channel 12 for reception of the sheets to be fastened together. Located exteriorly of the housing is a handle or actuator 13. A plunger 15 is slidably mounted in and through the top of the housing 11, a compression spring 16 extends between the top of the housing and a spring retaining cap 17 on the plunger; the handle 13 being connected to the plunger 15 at the cap 17. If desired, the cap 17 could be enlarged to function as a handle, using a pivoting arrangement at an end of the handle. The plunger 15 is attached at its lower end to a reciprocating member 18 which carries a hollow three sided punch or shear 19 and a chisel or flat cutter 20. A stop member 21 is also mounted on member 18. Pivotally mounted within the punch 19 is an arcuate-shaped finger of bending member 22.

The normal position of the handle 13, plunger 15, and reciprocating member 1 is shown in full outline in FIG. 3, while the actuating position of these members is shown in dotted outline in FIG. 3.

Pushing down on the handle pushes down the plunger 15 and the reciprocating member 18. This pushes down the punch 19 and chisel 20. The punch 19 and chisel 20 cuts through sheets positioned in the slot 12, the punch cutting a tongue of paper from each sheet, the tongues being bent down. The chisel 20 cuts a slot positioned back from the bends of the tongues. After cutting the sheets, an extension 23 of the finger 22 contacts the inner surface of the bottom wall 24. This causes the arcuate finger 22 to pivot, the curved end portion 25 bending the tongues of the sheets round and up, the free ends passing through a slot in the chisel 20. Releasing the handle causes the withdrawal of the finger and upward movement of the punch and chisel. The chisel pulls the free ends of the tongue up through the slot formed in the sheets. The stop member 21 limits movement of reciprocating member 18 by contacting the bottom of the housing.

Figure 4:
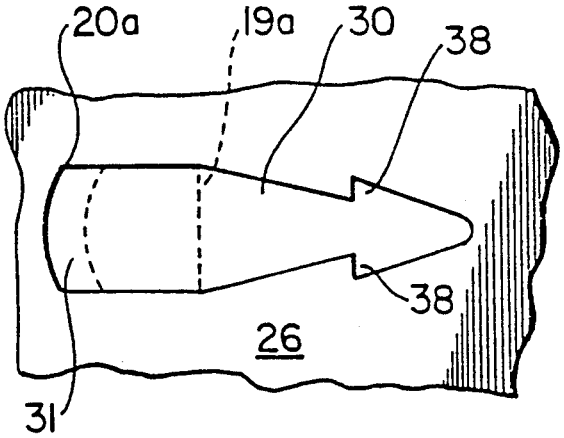
FIG. 4 is a plan view to an enlarged scale of the cutting apertures in the die plate generally on the lines 5—5 in FIG. 3.

FIG. 4 illustrates more clearly the aperture in the top surface 26 of the base 10, which acts as a die plate. The aperture has two main portions 30 and 31. The portion 30 is for the punch 19 and portion 31 is for the chisel 20. The adjacent edges of punch and chisel are spaced apart, these edges being indicated by the dotted lines **19*a* and 20*a*. Portion 30 also illustrates the shape of the tongues cut from the sheets and portion 31** corresponds to the slot cutting machines.

Figure 7:
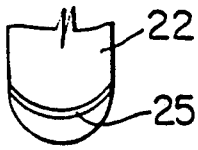
FIG. 7 is a view of the modified bending member, as used in the direction of arrow B in FIG. 6.

FIGS. 4 and 7 illustrate in greater detail the shape of tongue-shaped portions and also the arcuate cross-section of the tongue shaped sections, normal to their length. As shown in the example, the punch profile has generally an enlarged leading end in the shape of an arrow-head profile, to form extensions on the opposite side of the sections. These extensions are formed by extensions 38, both on the punch and the aperture. The third end 25 of the finger is given an arcuate form, as seen in FIG. 7. As the curved end of the finger meets the bent down tongue shaped sections, these will assume a bent or trough shape. This makes the sections stiffer, and improves the ability to push the free ends into the slot in the chisel. Once the ends have been pulled through the slot in the sheet, the projections will resist pulling out of the sections, ensuring an effective fastening.

Figure 5:
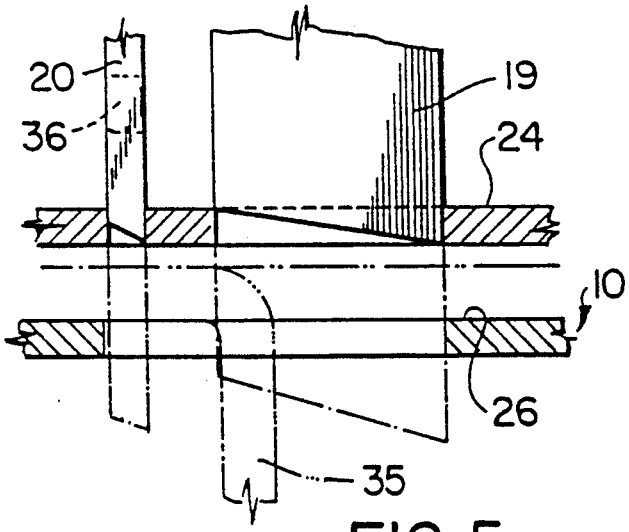
FIG. 5 is an enlarged side view of the cutting tools and the plate, generally on the line 6—6 of FIG. 4, prior to cutting the material.
Figure 6:
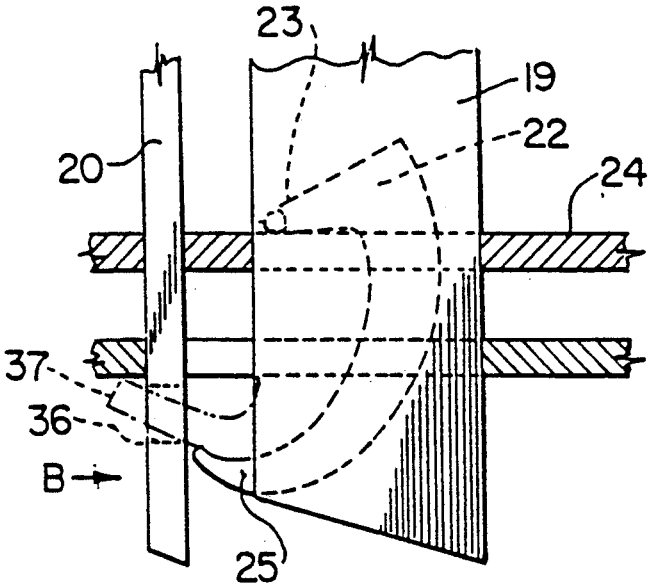
FIG. 6 is a similar view to that of FIG. 6, showing the cutting tools in the downward position, and the tongue-shaped section is deflected.

FIGS. 5 and 6 illustrate the progressive positions of punch and chisel, in operation. In full outline in FIG. 5, the punch 19 or chisel 20 are shown in full upward position, when the handle 13 has been fully pushed up. The lower, cutting, edges of punch and chisel are positioned in the bottom wall 24 of the housing. On initial movement of the handle, the punch and chisel move down, cutting tongue shaped sections and a slot, the tongue shaped sections being bent down as indicated in dotted outline at 35. The punch and chisel will then be at the positions indicated in dotted outlines. Also shown in FIG. 5 is a slot 36 in the chisel 20. FIG. 6 illustrates the position of the punch 19 and chisel 20, and also the pivoting finger 22 with the handle 13 fully depressed. As the handle is pushed down from the position corresponding to FIG. 5, an extension 23 on the finger 22 contacts the bottom wall 24, pivoting the finger 22, causing end portion 25 to push the tongue shaped sections around and up and through the slot 36 in the chisel, as indicated in dotted outline at 37. Releasing the handle causes the punch and chisel to retract, the finger pivoting back, and the chisel pulling the ends of the tongue shaped sections up through the slot cut in the sheets. The sheets are now fastened together by the tongue shaped sections.

Figure 8:
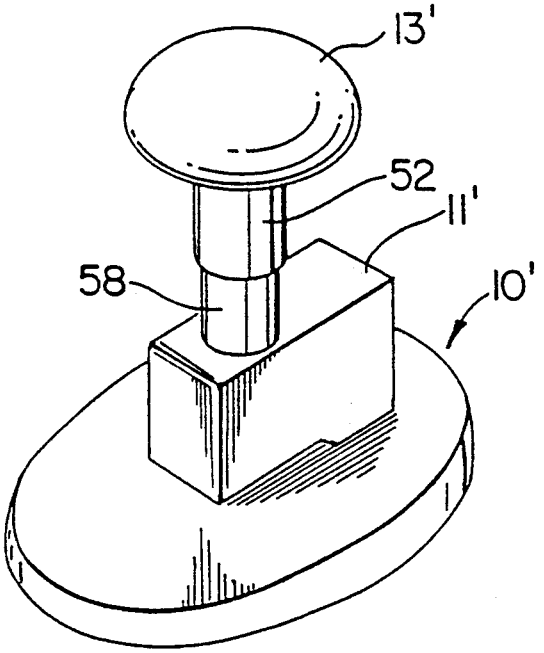
FIG. 8 is an alternative embodiment showing the perspective view.
Figure 9:
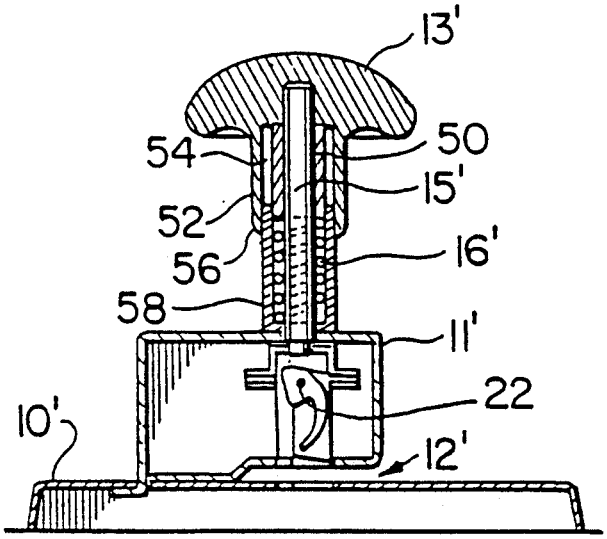
FIG. 9 is a vertical sectional view of the embodiment of FIG. 8.
Figure 10:
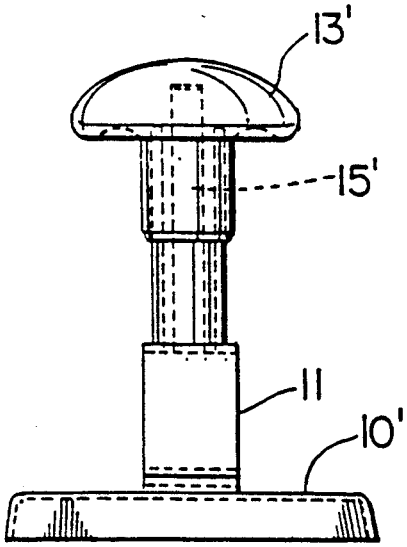
FIG. 10 is an end elevational view of the embodiment of FIG. 8.

Referring to the embodiments shown in FIGS. 8 through 10, similar reference numerals used in FIGS. 1 to 7 for similar components have been used, except that such similar reference numerals are designated with a prime (').

In the modified version shown in FIGS. 8 to 10, the shaft 15' extends upwardly through a bushing 50 surrounding the shaft and which is adapted to retain the spring 16'. The upper end of the shaft 15' terminates in the handle or cap 13'. The cap 13' has a downwardly extending circumferential leg 52 with a gap 54 between the bushing and the leg 52. The cap terminates at its lower and (designated by reference numeral 56) exteriorly of a protective housing 58 which encloses the spring 16'.

As will be seen from FIG. 9, the housing 58 extends upwardly into the gap 54 to form a closed structure.

Figure 11:
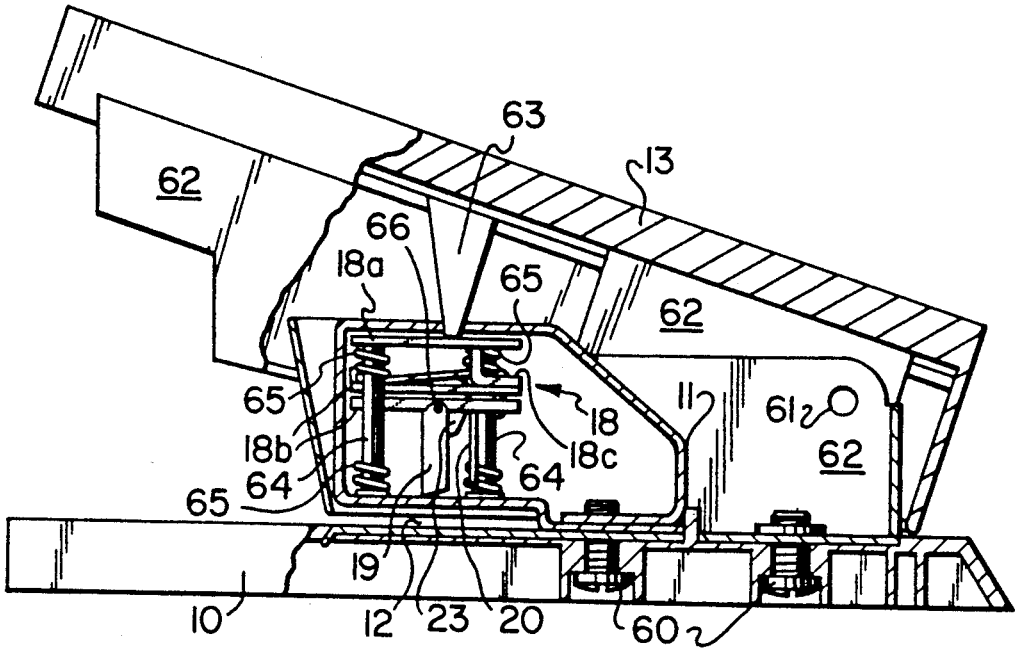
FIG. 11 is a cross-section, similar to that of FIG. 3, of a further embodiment.

FIG. 11 illustrates an embodiment of the invention in which the handle is in the form of an elongate member, pivotally mounted, resembling a particular form of conventional stapler. Where applicable, the same reference numerals are used for items common with the embodiment of FIGS. 1 to 7.

In the form as illustrated in FIG. 11, the base 10 is more elongate. The housing 11 is mounted on the base, by screw 60, with gap 12 being provided for the sheets to be fastened. The handle 13 is of elongate form and is pivotally mounted at one end on a rod 61 positioned in extending side walls 62 of the housing 11. Spaced fingers 63 extend from the handle 13 are in contact with the reciprocating member 18, the fingers extending through slots in the top surface of the housing. The reciprocating member 18, in the example, has an upper member 18*a* and a lower member 18*b* connected together by attachment members 18*c*. Attached to the lower member 18*b* is a hollow, three-sided punch or shear 19 and the chisel or flat utter 20. The upper member—18*a* slides on two columns 64 mounted at their bottom ends on the bottom surface of the housing 11. Springs 65 bias the upper member 18, and thus the whole reciprocating member 18, with punch 19 and chisel 20, upwards away from the base. Mounted within the punch 19 but not seem in FIG. 11 is the arcuate FIG. 22, the finger being pivotally mounted on pivot 66. The handle 13 is of trough-shape formation, with the side walls 62 extending down to cover the housing 11, preventing the pinching of fingers by operators and also providing an attractive form.

Figure 12:
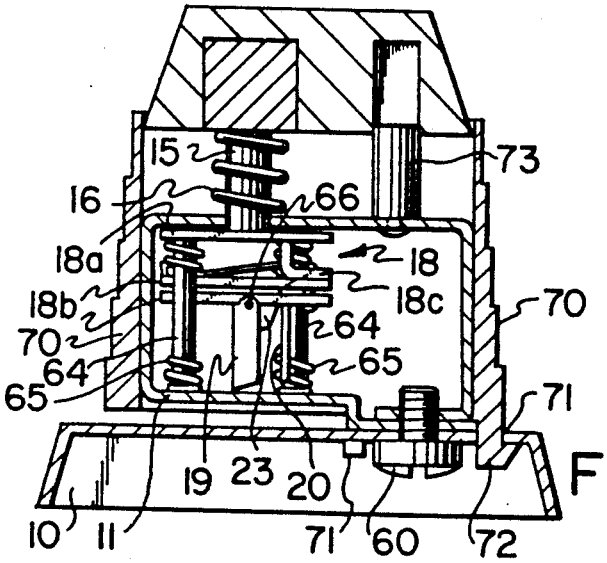
FIG. 12 is a cross-section, similar to that of FIG. 11, of another embodiment.

FIG. 12 illustrates an alternative form in which the cap moves vertically, sliding within the housing. Again, the same reference numerals are used for common items. The housing 11 is attached to the base 10, by screws 60. In this example, the housing 11 is of rectangular form, in plan view, and is enclosed in a casing 70, for example a molded casing, connected to the base 10 by flexible finger 71 passing through holes in the top of the base. The fingers deflect as the enlarged end 72 is pushed through, the end snapping out and engaging against the top of the base. The handle 13, for example of moulded form, slides in the casing 70. The handle reciprocates on one or more pillars 73 mounted on the housing, and carries a plunger 15 surrounded by a spring 16.

The plunger 15 acts on the reciprocating member 18, with punch or shear 19, chisel 20 and arcuate finger 22 (not seen in FIG. 12) as in the embodiment illustrated in FIG. 11.

The operation of the embodiments illustrated in FIGS. 11 and 12 is in the same manner as in the embodiments illustrated in FIGS. 1 to 7.

I claim:

1. A stapleless paper fastening apparatus comprising:

a base;

a housing mounted on said base;

a tubular member mounted on said housing, said tubular member having a inwardly extending annular flange at a bottom end, the flange defining a central aperture;

a shaft in tubular member, coaxial therewith and slidable axially through said central aperture into said housing;

a handle reciprocally mounted on said tubular member for movement towards and away from said housing, said handle including an outer annular member slidable on the outside of said tubular member, and also having an inner annular member slidable on the inside of said tubular member;

a spring positioned between said annular flange and a bottom end of said inner annular member, urging said handle away from said housing;

said shaft attached at an upper end to said handle for movement with said handle;

a punch and chisel reciprocally mounted in said housing for movement by said shaft, said punch having a hollow U-shaped cross-section adapted to cut a tongue-shaped section from said sheets;

a bending member pivotally mounted in said punch, said bending member including means for engaging on the bottom part of said housing to pivot the bending member;

the whole arranged such that initial actuation of said handle pushes down said punch and said chisel to cut tongue-shaped sections from said sheet and cut a slot in said sheet, continued actuation of the handle pivoting said bending member to bend up to the tongue for insertion into the slot cut by said chisel.

2. Apparatus as claimed in claim 1, said punch having an enlarged leading end, of an arrow-head configuration.

3. Apparatus as claimed in claim 2, including a slot extending through said chisel, adjacent the free end thereof, said tongue shaped sections adapted to be inserted into the slot and chisel by said bending member with retraction of said chisel being adapted to pull said tongue shaped sections through said slot cut in the sheets by said chisel.

4. Apparatus as claimed in claim 2, wherein the enlarged head end of said punch has a projection on at least one side to form a projection on at least one side to form a projection on the corresponding side of the tongue shaped sections.

5. Apparatus as claimed in claim 4, said punch having a projection on each side adjacent its closed end, to form a projection on each side of each tongue-shaped section adjacent its free end.

6. Apparatus as claimed in claim 1, including a reciprocating member in said housing mounted on an inner end of said shaft, said punch and said chisel mounted on said reciprocating member.

7. Apparatus as claimed in claim 6, including a stop member on said reciprocating member, for limiting movement of said reciprocating member towards said base.

8. Apparatus as claimed in claim 1, said bending member comprising an arcuate member, a curved end portion of the arcuate member bending said tongue-shaped sections.

9. Apparatus as claimed in claim 1, said bending member having a curved end portion when viewed from the side, said curved end portion having an arcuate cross-section, with the concave surface facing inward, whereby the free ends of the tongue-shaped sections are formed into a trough like form as they are pushed by said bending member.

* * * * *